US007090301B2

(12) United States Patent
Stadlbauer

(10) Patent No.: US 7,090,301 B2
(45) Date of Patent: Aug. 15, 2006

(54) APPARATUS AND METHOD FOR LUMBAR SUPPORT STRUCTURE

(75) Inventor: Alfred Stadlbauer, Linz (AT)

(73) Assignee: L&P Property Management Company, South Gate, CA (US)

( * ) Notice: Subject to any disclaimer, the term of this patent is extended or adjusted under 35 U.S.C. 154(b) by 155 days.

(21) Appl. No.: 10/282,611

(22) Filed: Oct. 29, 2002

(65) Prior Publication Data

US 2004/0080202 A1 Apr. 29, 2004

(51) Int. Cl.
*A47C 7/40* (2006.01)

(52) U.S. Cl. ..... 297/452.52; 267/133; 297/284.4; 297/452.3

(58) Field of Classification Search ..... 297/452.3, 297/452.29, 284.4, 452.52; 267/89, 103, 267/104, 105, 110, 133
See application file for complete search history.

(56) References Cited

U.S. PATENT DOCUMENTS 1,203,293 A * 10/1916 Wilkinson ..... 297/452.63
2,835,312 A * 5/1958 Neely ..... 267/105
2,855,984 A * 10/1958 Majorana et al. ..... 297/378.1
4,283,046 A 8/1981 Bowles, Jr. ..... 267/102
4,407,492 A * 10/1983 Muzzell ..... 267/103
4,697,848 A * 10/1987 Hattori et al. ..... 297/452.34
4,854,643 A * 8/1989 Cojocari et al. ..... 297/452.52
5,474,358 A 12/1995 Maeyaert ..... 297/284.7
5,697,672 A 12/1997 Mitchell ..... 297/284.4
5,988,745 A 11/1999 Deceuninck ..... 297/284.4
6,152,531 A 11/2000 Deceuninck ..... 297/284.4

FOREIGN PATENT DOCUMENTS

EP 0 128 407 B1 7/1987
GB 2 342 287 A 4/2000

* cited by examiner

*Primary Examiner*—Peter R. Brown
(74) *Attorney, Agent, or Firm*—Husch & Eppenberger, LLC; Grant D. Kang

(57) ABSTRACT

The invention is a lumbar support structure adapted to attach to a frame of a seat. An upper support bar and a lower support bar attach to the frame of the seat. A plurality of vertical springwires connect to the support bars. Spacers are used to maintain a desired distance between each of the springwires. A lumbar portion of the springwires extends away from a plane containing the support bars. By utilizing different diameter springwires and different shaped lumbar portions a saddle support distribution is created. The saddle support distribution allows the structure to customize the response to an occupant sitting in the seat.

23 Claims, 3 Drawing Sheets

APPARATUS AND METHOD FOR LUMBAR SUPPORT STRUCTURE

CROSS-REFERENCE TO RELATED APPLICATIONS

None.

STATEMENT REGARDING FEDERALLY SPONSORED RESEARCH OR DEVELOPMENT

Not Applicable.

BACKGROUND OF THE INVENTION

1. Field of the Invention

This invention concerns a weight support device for seats. More specifically, the invention is drawn to a wire array for a seat to support the back of a seated occupant. The support is generated by conforming the shape of the device to the particular seat into which it is installed and also by conforming the shape of the device to the lower back region (i.e. lumbar region) of the occupant, either statically or dynamically.

2. Related Art

It is known to provide generally static wire arrays for seat support that can also be manipulated to adjust for lumbar support in a seat. See U.S. Pat. Nos. 5,474,358; 5,697,672; 5,988,745 and 6,152,531, European Patent No. 0128407A1 and UK patent application GB 2342287A (all commonly owned and hereby incorporated by reference) for examples of the prior art. All of these disclosures utilize a horizontal array of wires to provide support. Vertical elements only space the wires to distribute applied loads. Multiple attaching devices must be used to attach the devices to a frame in a seat to prevent unwanted twisting of the support.

All of these devices provide static support. They are all flexible enough to have their shape and tension altered dynamically by any of a variety of user control mechanism. These horizontal arrays address a constant industry need for controlling component cost. However, installation in various seat frames requires multiple mounting components especially when a dynamic capability is added. Moreover, the load bearing and tension control characteristics of horizontal wires, bent or straight, have low adaptability to various seat frames and to individual seat occupants.

Some of these horizontal devices utilize different shapes in the wires to increase the effective area providing support. None of the patents disclose the use of different diameter wires and different shapes to customize the response to an applied load.

U.S. Pat. No. 4,283,046 discloses a static system utilizing an array of vertically arranged wires to provide uniform support. This device also discloses one mechanism to change the profile of the support. This device does not disclose the use of different diameter wires and different bending patterns to customize the response to an applied load.

There is a need in the industry for a vertical wire array that controls component cost and provides greater adaptability of installed load bearing and tension response characteristics.

SUMMARY OF THE INVENTION

The invention is a lumbar support structure adapted to attach to a frame of a seat. Horizontal upper and lower support bars attach to the frame of the seat. A plurality of vertical springwires connect to the support bars. Horizontal spacers are used to maintain a desired distance between each of the springwires. A lumbar portion of the springwires is curved toward a seat occupant, extending away from a plane defined by the support bars. By utilizing different diameter springwires and different shaped lumbar portions of the springwires, a saddle type support distribution is created. The novel combination of vertical alignment with variable wire diameter and bending patterns allows the structure to customize the wire array to the seat into which it is installed and its response to an occupant sitting in the seat.

Further features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated in and form a part of the specification, illustrate the embodiments of the present invention and together with the description, serve to explain the principles of the invention. In the drawings.

DESCRIPTION OF THE PREFERRED EMBODIMENTS

Figure 1:
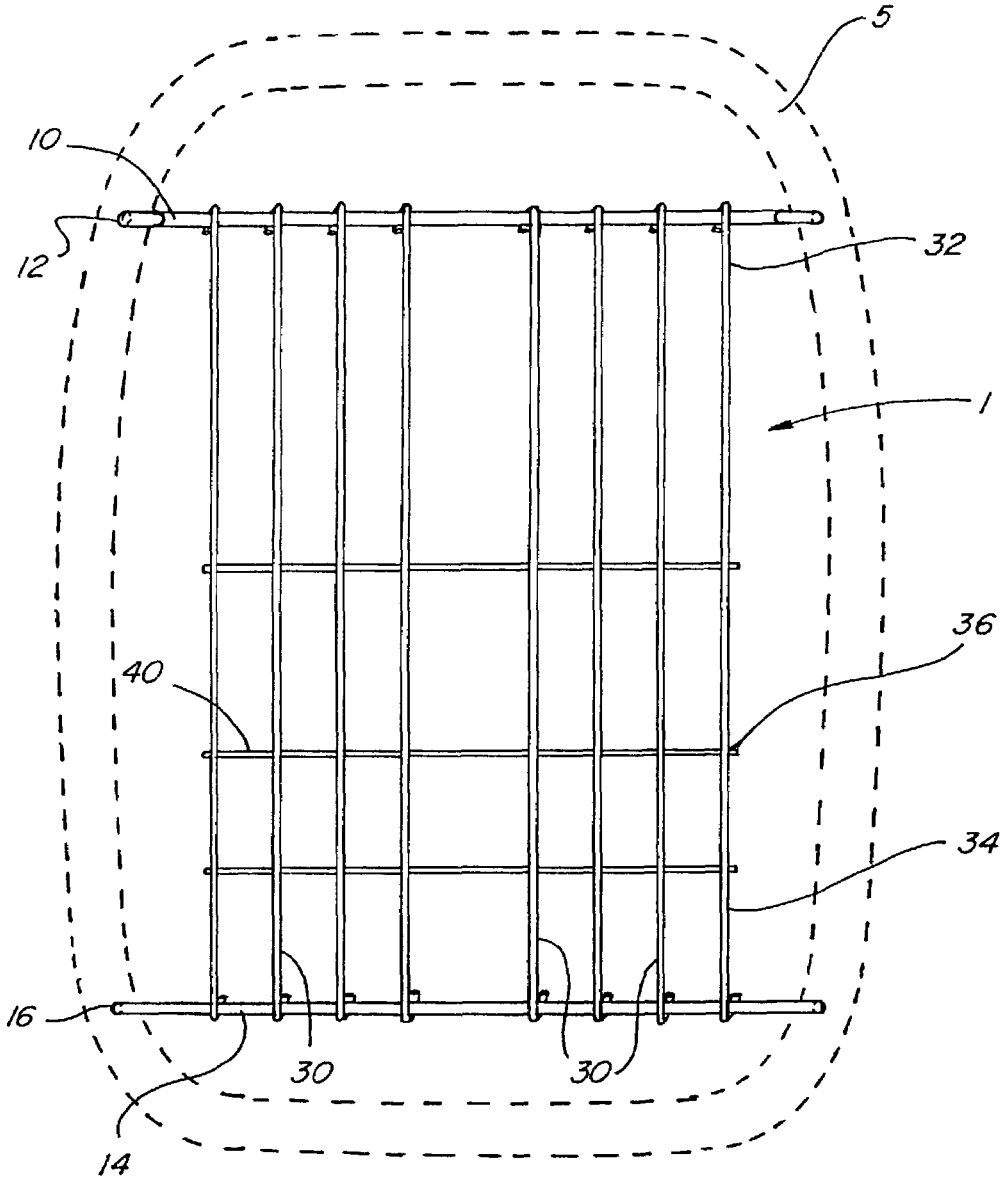
FIG. 1 illustrates a front plan view of the Lumbar Support Structure.

Referring to the accompanying drawings in which like reference numbers indicate like elements, FIG. 1 illustrates the support structure 1 viewed from the front. The support structure 1 provides support to the occupant of a seat. In the preferred embodiment the invention is incorporated into an automobile seat but could be used in any type of seat. The support structure 1 attaches to a frame 5 (shown in shadow) of the seat (not shown).

The support structure 1 comprises an upper support bar 10 and a lower support bar 14. An upper attachment device 12 attaches the upper support bar 10 to the frame 5. In one preferred embodiment, upper attachment device 12 is a pair of clips which connect to holes on the frame 5. A lower attachment device 16 attaches the lower support bar 14 to the frame. In one preferred embodiment, the lower attachment device 16 is a pair of clips. Of course any type of attachment device could be utilized. For example the upper support bar could fit into the crook of a hook attached to the frame. Alternatively, the attaching clip may be an inexpensive bend fabricated into the end of the support bars 10 and 14. Consequently, mounting component costs are reduced.

A plurality of vertical spring wires 30 are attached to the horizontal bars 10 and 14. The horizontal bars 10 and 14 are more rigid than the vertical spring wires. This further reduces any need for expensive mounting components that might otherwise be needed to prevent twisting. Also, rigid horizontal support bars 10 and 14 provide a desirable resistance to load bearing flexion of the vertical springwires 30. In one preferred embodiment, the upper support bar 10 and lower support bar 14 are rods of spring steel and have a diameter of 4 to 5 mm.

Upper support bar 10 and lower support bar 14 define a support plane. The plurality of springwires 30 attach at an upper portion 32 to the upper support bar 10 and at a lower portion 34 to the lower support bar 14. A lumbar portion 36 is located between upper portion 32 and lower portion 36. Preferably, the lumber portion 36 is curved towards a seat occupant for support, although flat wire assars are within the scope of the present invention.

At least one spacer 40 has a plurality of holes that allow the plurality of springwires 30 to pass through the holes. The spacer 40 maintains a desired distance between the springwires 30. The spacer 40 is made of plastic in one preferred embodiment, but could be made of any suitable material. In one preferred embodiment, the spacer 40 is operatively connected to the springwires 30 using the holes mentioned above but the springwires 30 could be operatively coupled to the spacer 40 in any suitable manner. For example, the springwires 30 could wrap around the spacer.

Figure 2:
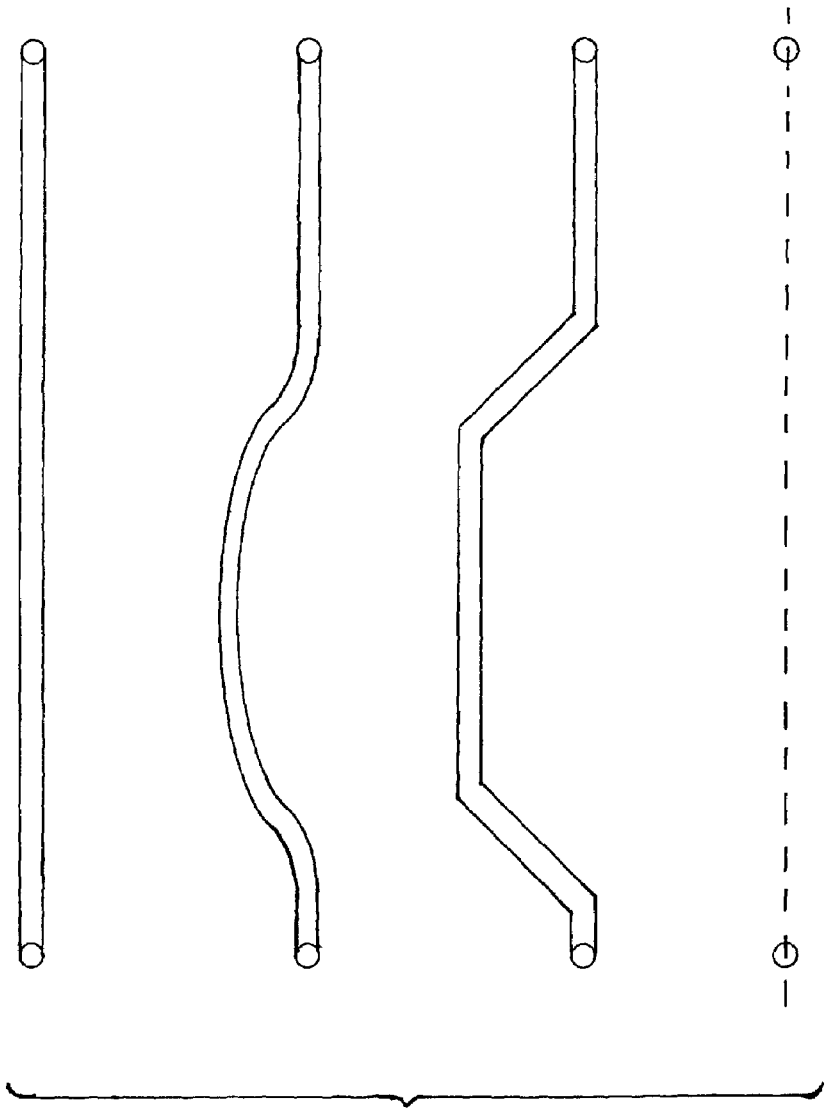
FIG. 2 illustrates side views of various springwire bending patterns.

The lumbar portion 36 of springwires 30 extends away from the support plane to provide support to the occupant of the seat. Alternatively, the wire array comprising the support structure 1 may be flat. Different shapes or bending patterns are incorporated into lumbar portion 36 to provide the desired support. The lumbar portion 36 of each wire can be arc shaped, round, trapezoidal, see FIG. 2, or any other suitable shape. Each varying shape will have varying load bearing characteristics. Moreover, various combinations of the shape of adjacent wires allow for an adaptability of the weight bearing and tension response characteristics of the wire array as a whole. The variability of the disclosed system allows for a much greater degree of adaptability of installation of the wire array in different seats with different frames and different dynamic adjustment mechanisms than was provided in the prior art, without increasing cost.

Upper support bar 10 and lower support bar 14 define a support plane. The plurality of springwires 30 attach at an upper portion 32 to the upper support bar 10 and at a lower portion 34 to the lower support bar 14. A lumbar portion 36 is located between upper portion 32 and lower portion 34. Preferably, the lumber portion 36 is curved towards a seat occupant for support, although flat wire array are within the scope of the present invention.

Individual springwires 30 may also made of different diameter wires. The stiffness of the springwires 30 is a function of the material and the thickness or gauge of the wire. The thicker springwires are stiffer than thinner springwires. Of course, different materials may also be used, such as metal straps or plastic members. Accordingly, even greater adaptability of the system is available.

The configuration of the support structure 1 can be adjusted according to design requirements. It has been determined that the most comfortable arrangements of lumbar support incorporate a saddle support distribution 50 into the design, see FIG. 3. A preferred saddle support distribution 50 provides a region of reduced support adjacent to the passenger's spine, bordered laterally by regions of increased support. The support device 1 has a centerline corresponding to the spine of an occupant 52. Preferably, there are no springwires in the centerline. A first pair of springwires 30A is disposed adjacent the centerline. The first pair of springwires has a first stiffness. A second pair of springwires 30B is disposed outside of the first pair of springwires and has a second, preferably increased stiffness. Subsequent pairs of springwires 30C are disposed outside of the preceding pair of springwires and have additional stiffness. The saddle support distribution is created by having the springwires increase in stiffness from the centerline outward up to a maximum stiffness. The farthest lateral springwires may decrease in stiffness. The use of differing shapes 54A, 54B and 54C in the lumbar region of progressive spring wire pairs will allow further customization of the support. These shapes may be different bending patterns, or may be different sizes of the same pattern.

Figure 3:
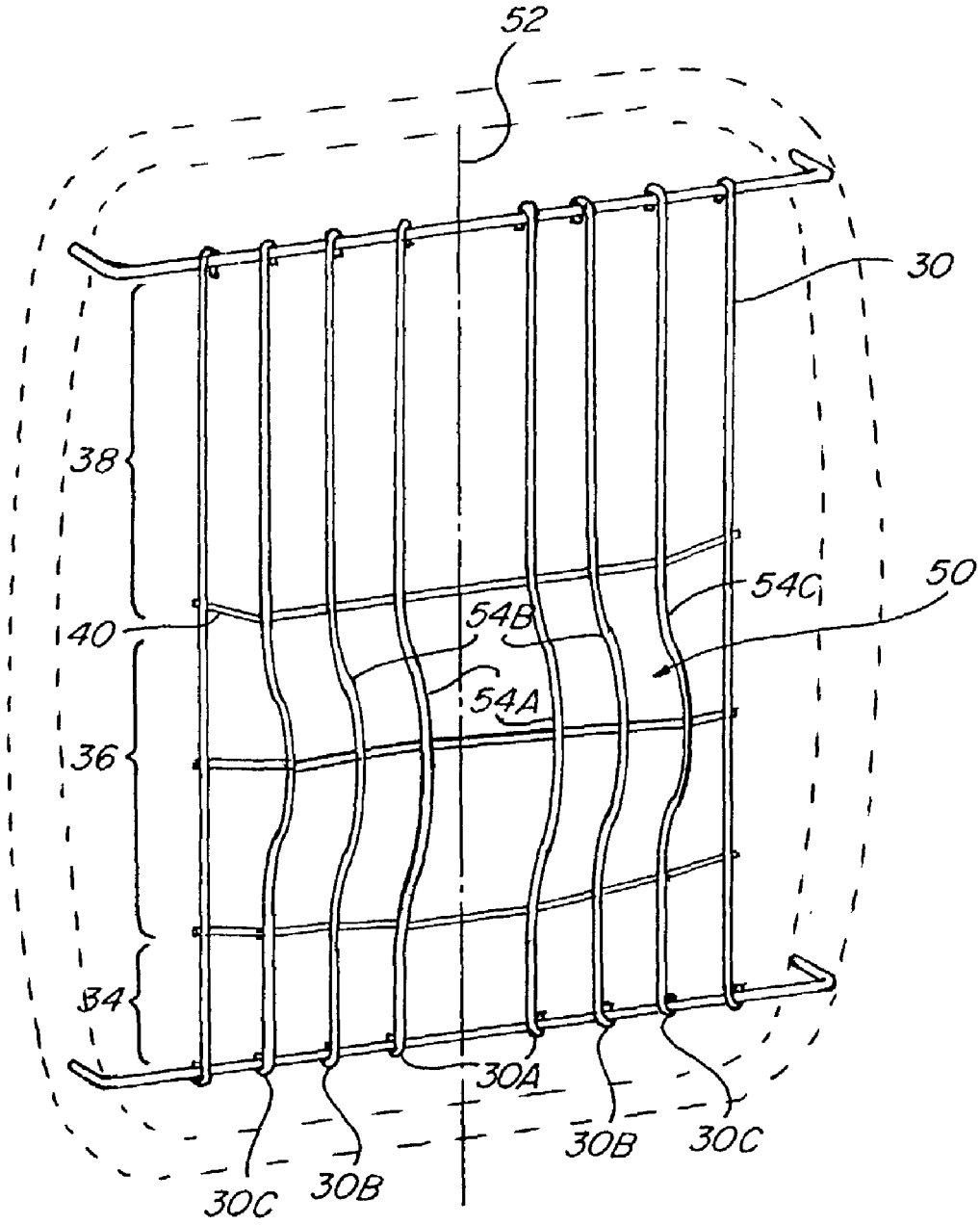
FIG. 3 illustrates the saddle support distribution.

Furthermore, greater adaptability of the system may be achieved by making one or more of the springwires longer than other springwires, as shown for example in FIG. 3 where any one of springwires 30A, 30B, or 30C is longer (due in this case to bends in these wires) than at least one other springwire, such as springwire 30. Use of longer springwires closer to the centerline is another way to generate a saddle support distribution as described above, for example in FIG. 3 springwires 30A, 30B, and 30C are more centrally disposed relative to springwire 30.

In use the device will be incorporated into a seat. The upper support bar and lower support bar attach to the frame of the seat. The rest of the padding and covering will then be added to the seat. Provided an occupant sits in the center of the seat, the empty portion along the centerline will line up with the occupant's spine yielding slightly as the occupant presses back into the seat. The springwires will then provide resistance. The stiffest resistance will come from the springwires with the highest stiffness. The saddle support distribution cradles the spine of the occupant.

In fabrication and assembly, the wire gauges, bending patterns and saddle shape may all be adjusted to accommodate a variable range of seat designs, frames and dynamic support adjustment mechanisms that a seat manufacturer may use. Accordingly, this single wire array product may be quickly and inexpensively customized for use in a broad range of seats without redesign or retooling.

The shaped, vertically aligned wire array is adaptable to any manner of dynamic tensioning system. The shape of the spring wires in their lumbar portion 36 can be changed to accommodate horizontal strap type systems, bowing systems using vertical tension or compression, or push paddle type support systems.

The vertical springwire configuration provides advantages over the horizontal springwire configuration. Prior art horizontal springwires flexed outwardly when loaded. In contrast, the vertical springwire configuration is relatively fixed at an upper portion and a lower portion to the support bars. When loaded the wires do not have the room to flex and thus the springwires are placed in compression, increasing their resistance to progressive loading. These load characteristics are then customized by incorporating variable bending patterns.

In view of the foregoing, it will be seen that the several advantages of the invention are achieved and attained.

The embodiments were chosen and described in order to best explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting. For example, the spacer is disclosed as having a hole that passes over a springwire, but the spacer could also be glued to the springwire. Thus, the breadth and scope of the present invention should not be limited by any of the above-described exemplary embodiments, but should be defined only in accordance with the following claims appended hereto and their equivalents.

What is claimed is:

1. A support structure for incorporation in a frame of a seat comprising:

a first support bar having a first attachment device adapted to affix said first support bar to the frame;

a second support bar substantially parallel to and spaced apart from said first support bar and having a second attachment device adapted to affix said second support bar to the frame, wherein said first support bar and said second support bar define a support plane, the support plane having a centerline which is substantially orthogonal to said first and said second support bars, said centerline being substantially aligned with the center of at least one of said first and said second support bars; and a plurality of springwires having an first portion connected to said first support bar, a second portion connected to said second support bar and a lumbar portion located between said first portion and said second portion, wherein there is an increased stiffness in said springwires disposed further away from said centerline.

2. The support structure of claim 1 further comprising at least one spacer substantially parallel to said first support bar and said second support bar and being operatively connected to said plurality of springwires such that said plurality of springwires are spaced within said support structure.

3. The support structure of claim 1 wherein said lumbar portion extends outwardly from said support plane, said lumbar portion comprising a bend selected from a group consisting of an arc, a trapezoid, an angle, a curve, a sinusoid and an s curve.

4. The support structure of claim 3 wherein said bends in said lumbar portions of some of said springwires are different from said bends in said lumbar portions of other springwires.

5. The support structure of claim 3 wherein said bends are in a plane orthogonal to said springwires.

6. The support structure of claim 1 wherein no springwire is located at said centerline or immediately adjacent thereto.

7. The support structure of claim 1 wherein some of said springwires have different gauges than other of said springwires, thereby causing said increased stiffness.

8. The support structure of claim 1 wherein some of said springwires have different bends than other of said springwires thereby causing said increased stiffness.

9. The support structure of claim 1 wherein said plurality of springwires are made of different materials.

10. The support structure of claim 1 wherein said first and second attachment devices further comprise ends of said springwires inserted into the frame.

11. The support structure of claim 1 wherein said plurality of springwires is disposed in pairs about said centerline, each of said pairs of springwires comprising a different stiffness.

12. A method of assembling a wire array for seat support comprising:

providing a substantially horizontal upper support bar and a substantially horizontal lower support bar to mount on a seat frame, said horizontal upper support bar and said lower support bar defining a plane having a vertical centerline;

disposing on said support bars a plurality of substantially vertical springwires; and creating a support distribution with an increasing stiffness in said springwires further away from said vertical centerline.

13. A support structure for incorporation in a frame of a seat comprising:

a pair of support bars disposed substantially horizontally; and a plurality of wires connected between said pair of support bars, said wires comprising a lumbar portion located between said upper portion and said lower portion, wherein said plurality of wires are disposed in laterally symmetric wire pairs about a vertical centerline and wherein at least two adjacent springwires on each side of said vertical centerline differ in stiffness and form a support distribution comprising an increasing stiffness in said laterally symmetric wire pairs disposed further away from said vertical centerline.

14. The support structure of claim 13 wherein said stiffness of adjacent springwires is symmetrically arranged on opposite sides of said vertical centerline, said vertical centerline not having any springwire therein and on each immediately adjacent side thereof having an empty space without any springwire.

15. A support structure for incorporation in a frame of a seat comprising:

a first support bar segment disposed substantially horizontally;

a second support bar segment spaced apart from said first support bar segment;

a plurality of springwires having a first portion connected to said first support bar segment and a second portion connected to said second support bar segment, wherein at least one of said springwires has a gauge that is different from a gauge of another of said springwires; and wherein said springwires have an increasing stiffness as a function of distance from a vertical centerline.

16. The support structure of claim 15 wherein said springwires are disposed in a substantially vertical orientation.

17. The support structure of claim 15 wherein said first and second support bar segments define a support plane.

18. The support structure of claim 15 wherein said first support bar segment is substantially parallel to said second support bar segment.

19. The support structure of claim 15 wherein at least one of said first and second support bar segments has an attachment device adapted to affix said at least one of said first and second support bar segments to the frame.

20. The support structure of claim 15 wherein said springwires further comprise a lumbar portion which is located between said first portion and said second portion, said lumbar portion extending outwardly from said support plane.

21. The support structure of claim 20 wherein said lumbar portion further comprises a bend selected from a group consisting of an arc, a trapezoid, an angle, a curve, a sinusoid and an s curve.

22. A support structure for incorporation in a frame of a seat comprising:

a first support bar segment disposed substantially horizontally;

a second support bar segment spaced apart from said first support bar segment; and a plurality of springwires having a first portion connected to said first support bar segment and a second portion connected to said second support bar segment, wherein at least one of said springwires is longer than another of said springwires and wherein said wires of different lengths comprise a support system comprising an increased stiffness in said wires disposed further from a centerline of at least one of said first and said second support bar segments.

23. The support structure of claim 22 wherein said springwires that are disposed closer to a centerline of at least one of said first and said second support bar segments are longer than springwires disposed further from said centerline.

* * * * *